US011693360B2

(12) United States Patent
Kawasumi

(10) Patent No.: US 11,693,360 B2
(45) Date of Patent: Jul. 4, 2023

(54) IMAGE FORMING APPARATUS HAVING FAN TO SUCK AIR THROUGH A GAP BETWEEN EXTERIOR COVERS

(71) Applicant: CANON KABUSHIKI KAISHA, Tokyo (JP)

(72) Inventor: Ryoichi Kawasumi, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/729,444

(22) Filed: Apr. 26, 2022

(65) Prior Publication Data

US 2022/0365480 A1 Nov. 17, 2022

(30) Foreign Application Priority Data

May 13, 2021 (JP) ..... JP2021-081508

(51) Int. Cl.
*G03G 21/00* (2006.01)
*G03G 21/20* (2006.01)
*G03G 21/16* (2006.01)

(52) U.S. Cl.
CPC ..... *G03G 21/206* (2013.01); *G03G 21/1633* (2013.01); *G03G 2221/1645* (2013.01)

(58) Field of Classification Search
CPC ..... G03G 21/206; G03G 21/1633; G03G 2221/1645; G03G 2221/169; B41J 29/377; H05K 5/0213; H05K 7/20136; F24F 13/20; F24F 2013/205
USPC ..... 399/92, 107; 312/236; 361/678, 679.46, 361/679.48, 679.49; 454/275
See application file for complete search history.

(56) References Cited

U.S. PATENT DOCUMENTS

| | | | | |
|---|---|---|---|---|
| 10,990,059 | B2 | 4/2021 | Kawasumi et al. | G03G 21/1619 |
| 2008/0050145 | A1* | 2/2008 | Hanano | G03G 21/1633 399/92 |
| 2015/0248880 | A1* | 9/2015 | Matsuda | G03G 21/1619 312/223.1 |
| 2017/0160699 | A1* | 6/2017 | Imanari | G03G 21/206 |
| 2017/0219990 | A1* | 8/2017 | Ishida | G03G 21/1633 |
| 2019/0047306 | A1* | 2/2019 | Sasaki | B41J 29/377 |
| 2019/0196396 | A1* | 6/2019 | Ueda | G03G 21/20 |
| 2021/0063945 | A1 | 3/2021 | Kawasumi et al. | G03G 21/1633 |
| 2021/0063946 | A1 | 3/2021 | Watanabe et al. | G03G 21/1619 |

(Continued)

FOREIGN PATENT DOCUMENTS

JP 2004-347701 12/2004

OTHER PUBLICATIONS

U.S. Appl. No. 17/735,848, filed May 3, 2022.

*Primary Examiner* — Robert B Beatty
(74) *Attorney, Agent, or Firm* — Venable LLP

(57) ABSTRACT

An image forming apparatus includes a first exterior cover provided on a front surface of the image forming apparatus so as to be openable and closable, a second exterior cover provided on a side surface of the image forming apparatus, a third exterior cover fixed on a front surface side of the image forming apparatus and above the first exterior cover in a vertical direction, and a fan configured to suck outside air through a gap formed between the first exterior cover and the second exterior cover. In a state where the first exterior cover is closed, the gap formed between the first exterior cover and the second exterior cover is larger than a gap formed between the third exterior cover and the second exterior cover.

7 Claims, 15 Drawing Sheets

(56) References Cited

U.S. PATENT DOCUMENTS

2021/0096510 A1* 4/2021 Yuzawa ..... G03G 21/206

* cited by examiner

IMAGE FORMING APPARATUS HAVING FAN TO SUCK AIR THROUGH A GAP BETWEEN EXTERIOR COVERS

BACKGROUND OF THE INVENTION

Field of the Invention

The present invention relates to an image forming apparatus such as a printer, a copier, a facsimile machine, or a multifunction printer.

Description of the Related Art

For example, in an image forming apparatus using an electrophotographic technology, an image forming unit including a motor may be a heat source that generates heat by continuously performing an image forming operation on a recording material. Alternatively, since a fixing device including a heater applies heat in order to fix a toner image to the recording material, the fixing device and a conveyance device that conveys the recording material having passed through the fixing device can be heat sources. Then, although a temperature in the apparatus rises due to these heat sources, in a case where the image forming operation is continuously performed without suppressing a temperature rise in the apparatus, a temperature of a toner rises due to the high temperature in the apparatus, which causes a recording material conveyance failure, an image failure, a loading failure, and the like. Therefore, according to the related art, an apparatus, in which a fan is provided in an image forming apparatus and air is sucked from the outside to the inside of the image forming apparatus to suppress a temperature rise in the apparatus, has been proposed (JP 2004-347701 A).

In the apparatus described in JP 2004-347701 A, an air intake port is formed in an exterior cover on a front surface side of the apparatus, and air outside the image forming apparatus is sucked through the air intake port, thereby suppressing the temperature rise in the apparatus. The air intake port is provided with a so-called louver in which a plurality of plate-like members are arranged at intervals in order to suppress entry of foreign substance into the apparatus.

However, from the viewpoint of appearance quality of the apparatus, a configuration in which a louver is provided on the front surface side of the apparatus is not very desirable. Therefore, a configuration in which an air intake port including a louver is provided on a back surface side of the apparatus is considered. Meanwhile, in a case where the image forming apparatus is installed in a room, the back surface side of the image forming apparatus often faces a wall. Therefore, in a case where the air intake port is provided on the back surface side of the image forming apparatus, the air intake port faces the wall, so that the amount of air sucked through the air intake port decreases, and there is a possibility that the temperature in the image forming apparatus rises.

SUMMARY OF THE INVENTION

The present invention provides an image forming apparatus capable of having improved appearance quality and suppressing a temperature rise therein.

According to one aspect of the present invention, an image forming apparatus that forms an image on a recording material, the image forming apparatus includes a first exterior cover provided on a front surface of the image forming apparatus so as to be openable and closable, a second exterior cover provided on a side surface of the image forming apparatus, a third exterior cover fixed on a front surface side of the image forming apparatus and above the first exterior cover in a vertical direction, and a fan configured to suck outside air through a gap formed between the first exterior cover and the second exterior cover. In a state where the first exterior cover is closed, the gap formed between the first exterior cover and the second exterior cover is larger than a gap formed between the third exterior cover and the second exterior cover.

Further features of the present invention will become apparent from the following description of exemplary embodiments with reference to the attached drawings.

DESCRIPTION OF THE EMBODIMENTS

Image Forming Apparatus

Figure 1:
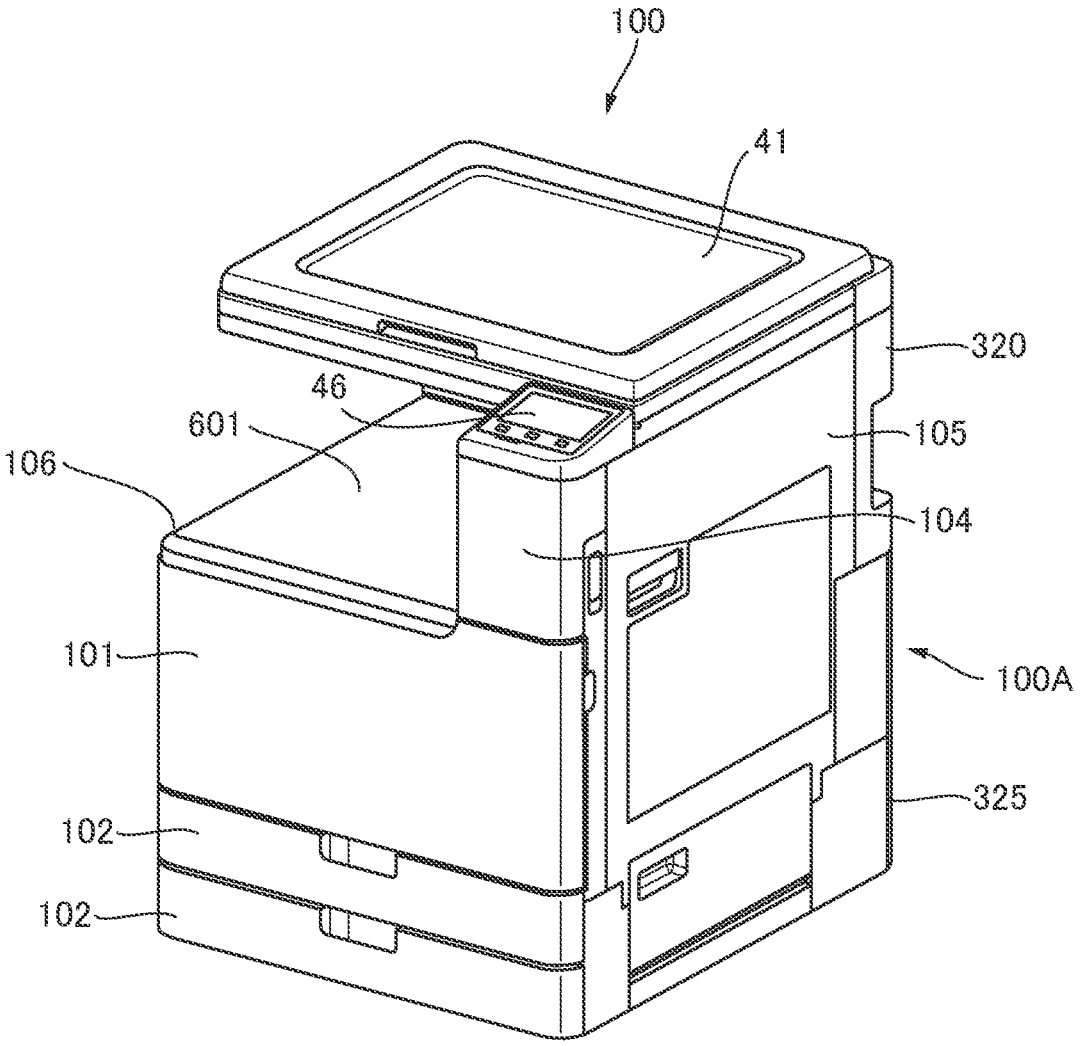
FIG. 1 is an exterior perspective view of an image forming apparatus according to the present embodiment as viewed from the front surface side.

Hereinafter, the present embodiment will be described. First, an outline of an image forming apparatus of the present embodiment will be described with reference to FIGS. 1 and 2. As illustrated in FIG. 1, an image forming apparatus 100 of the present embodiment is a so-called internal sheet discharge type image forming apparatus. That is, the image forming apparatus 100 includes a support frame 100A and a document reading device 41 that reads image information of a document, and a sheet discharge tray 601 on which the recording material S discharged from the support frame 100A is loaded is formed between the support frame 100A and the document reading device 41. An operation unit 46 including a display unit capable of displaying various types of information, a key capable of inputting various types of information according to a user operation, and the like is disposed on a front surface side of the support frame 100A, and an electrical unit 300 (see FIG. 14B) including a power supply board described later and the like are disposed on a back surface side of the support frame 100A. Note that, in the present specification, a side on which the user stands when operating the operation unit 46 to operate the image forming apparatus 100 is referred to as a "front surface", and a side opposite to the front surface is referred to as a "back surface". Further, a region closer to the front surface than the center in a front-back direction of the image forming apparatus 100 is referred to as a "front surface side", and a region closer to the back surface than the center in the front-back direction of the image forming apparatus 100 is referred to as a "back surface side".

The support frame 100A includes a front side plate 111 (see FIG. 11 as described later) provided on the front surface side of the image forming apparatus 100, a back side plate 121 (see FIG. 11) provided on the back surface side and supporting each unit together with the front side plate, a stay (not illustrated) connecting the front side plate and the back side plate, a plurality of sheet metals such as a support column supporting the front side plate, and the like, and is covered by an exterior cover constituting an appearance of the image forming apparatus 100. As the exterior cover, a front cover 101, a plurality of cassette covers 102, and a front upper cover 104 are disposed on the front surface side. As illustrated, in a vertical direction, the front cover 101 is disposed above the cassette cover 102, and the front upper cover 104 is disposed above the front cover 101. Further, side surface covers 105 and 106 are disposed on left and right side surface sides, respectively, and a back cover 325, an interface cover 320, a back upper cover 321 (see FIG. 15), and the like are disposed on the back surface side.

Figure 2:
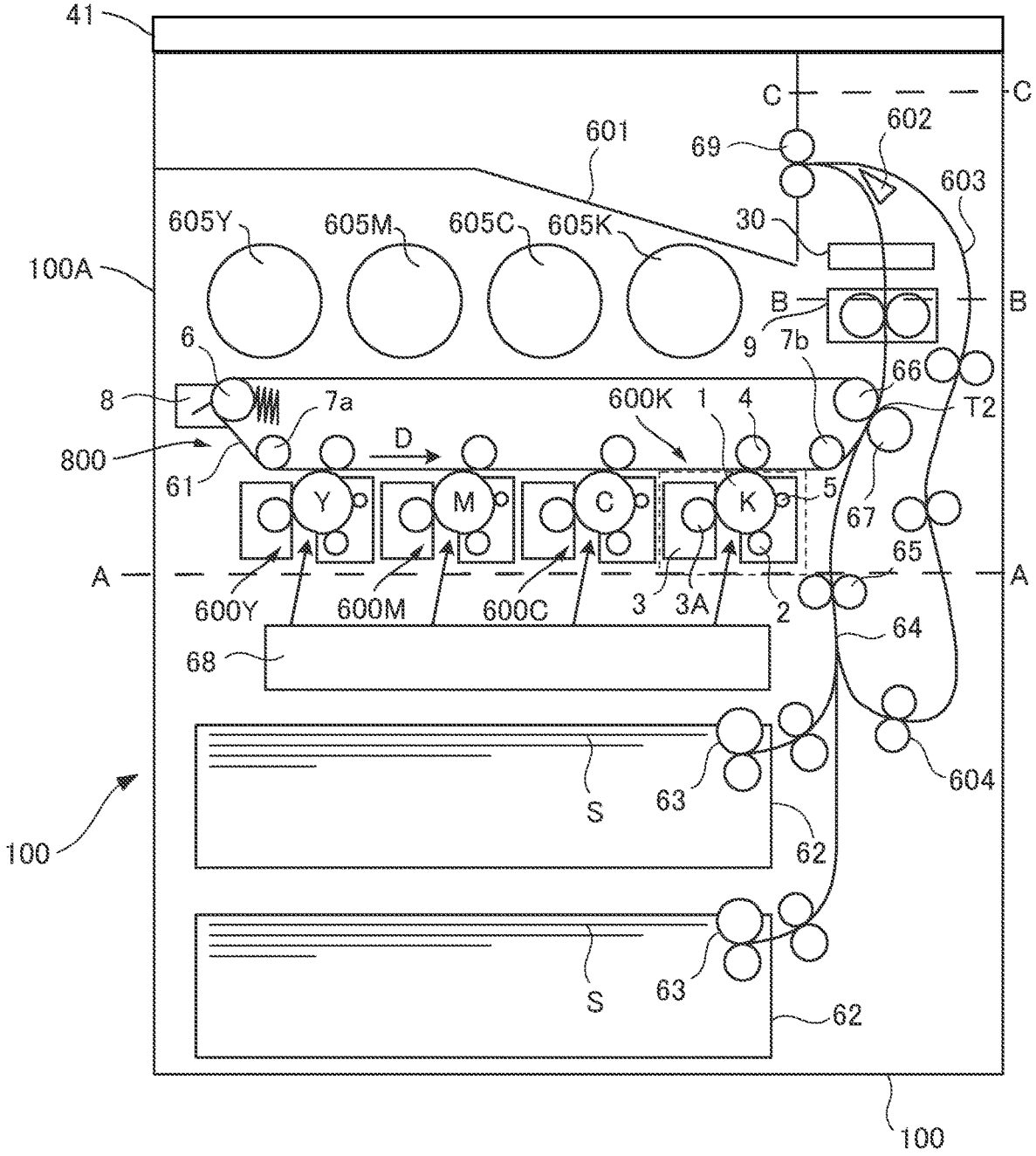
FIG. 2 is a schematic view illustrating a configuration of the image forming apparatus.

As illustrated in FIG. 2, the image forming apparatus 100 of the present embodiment is a so-called intermediate transfer type full-color printer in which image forming units 600Y, 600M, 600C, and 600K of four colors are arranged to face an intermediate transfer belt 61. The image forming apparatus 100 includes the image forming units 600Y, 600M, 600C, and 600K that form toner images of yellow, magenta, cyan, and black, respectively. The image forming apparatus 100 forms a toner image on the recording material S according to an image signal from the document reading device 41 provided above the support frame 100A or an external device (not illustrated) such as a personal computer. Examples of the recording material S include sheet materials such as paper, a plastic film, and cloth.

A recording material conveyance process of the image forming apparatus 100 will be described. The recording materials S are stored in a form of being loaded in one or more (here, two) sheet cassettes 62, and are supplied one by one by a supply roller 63 in accordance with an image forming timing. The recording material S supplied by the supply roller 63 is conveyed to a registration roller 65 disposed in the middle of a conveyance path 64. Then, skew correction and timing correction for the recording material S are performed in the registration roller 65, and the recording material S is conveyed to a secondary transfer portion T2. The secondary transfer portion T2 is formed by an inner secondary transfer roller 66 and an outer secondary transfer roller 67 facing each other with the intermediate transfer belt 61 interposed therebetween, and is a nip portion that transfers the toner image from the intermediate transfer belt 61 onto the recording material S by applying a predetermined pressure and an electrostatic load bias.

A process of forming an image sent to the secondary transfer portion T2 at the same timing as that of the process of conveying the recording material S to the secondary transfer portion T2 described above will be described. First, the image forming units 600Y to 600K will be described. However, since the image forming units 600Y to 600K of the respective colors are basically the same except for the color of the toner, the image forming unit 600K of black will be described below as an example. In FIG. 2, only the image forming unit 600K of black is denoted by a reference sign, and the image forming units of other colors are not denoted by reference signs.

The image forming unit 600K mainly includes a photosensitive drum 1, a charging device 2, a developing device 3, a photosensitive drum cleaner 5, and the like. A surface of the rotationally driven photosensitive drum 1 is uniformly charged in advance by the charging device 2, and then an electrostatic latent image is formed by an exposing device 68 driven based on a signal of image information. Next, the electrostatic latent image formed on the photosensitive drum 1 is visualized through toner development by the developing device 3. The developing device 3 develops the electrostatic latent image with a toner contained in a developer to form a toner image on the photosensitive drum 1.

Thereafter, a predetermined pressure and an electrostatic load bias are applied by a primary transfer roller 4 disposed to face the image forming unit 600K with the intermediate transfer belt 61 interposed therebetween, and the toner image formed on the photosensitive drum 1 is primarily transferred to the intermediate transfer belt 61. A residual primary transfer toner remaining on the photosensitive drum 1 after the primary transfer is collected by the photosensitive drum cleaner 5.

In the present embodiment, four sets of image forming units 600Y to 600K of yellow (Y), magenta (M), cyan (C), and black (K) are provided. However, the number of colors is not limited to four, and the arrangement order of colors is not limited thereto. In addition, the developing device 3 uses a two-component developer containing a nonmagnetic toner and a magnetic carrier as the developer. In this case, since the toner is consumed with the development, the toner can be replenished from each of toner bottles 605Y, 605M, 605C, and 605K containing the toner to the developing device 3 of each color.

The developer for replenishment stored in advance in the toner bottles 605Y to 605K is replenished to each developing device 3 by a toner replenishing device (not illustrated).

The intermediate transfer belt 61 to which the toner image is primarily transferred is an endless belt stretched by a tension roller 6, the inner secondary transfer roller 66, and stretching rollers 7*a* and 7*b* and moved in a direction of an arrow D in the drawing. The process of forming images of the respective colors processed in parallel by the image forming units 600Y to 600K of the respective colors described above is performed at a timing at which the toner images of the colors primarily transferred to the intermediate transfer belt 61 upstream in the moving direction are sequentially superimposed. As a result, a full-color toner image is finally formed on the intermediate transfer belt 61 and conveyed to the secondary transfer portion T2.

A residual secondary transfer toner remaining on the intermediate transfer belt 61 after passing through the secondary transfer portion T2 is collected from the intermediate transfer belt 61 by a transfer cleaner device 8. Note that the primary transfer roller 4 (Y, M, C, or K), the intermediate transfer belt 61, the tension roller 6, the inner secondary transfer roller 66, the stretching rollers 7*a* and 7*b*, and the like are integrally provided as an intermediate transfer belt unit 800.

By the conveyance process and the image forming process described above, the timings of the recording material S and the full-color toner image coincide with each other in the secondary transfer portion T2, and secondary transfer in which the toner image is transferred from the intermediate transfer belt 61 to the recording material S is performed. Thereafter, the recording material S is conveyed to the fixing device 9, and the fixing device 9 applies heat and pressure to fix the toner image to the recording material S.

The recording material S having passed through the fixing device 9 is conveyed to a sheet discharge roller 69 by a conveyance device 30, and is directly discharged onto the sheet discharge tray 601 by the sheet discharge roller 69 (single-sided mode) or conveyed to a duplex conveyance path 603 for double-sided image formation (double-sided mode). Note that the conveyance device 30 is a conveyance unit that includes a pair of rollers (not illustrated) and can convey the recording material S. In the double-sided mode, the recording material S is conveyed until a trailing edge passes through a switching member 602 by forward rotation of the sheet discharge roller 69, and then a leading edge and the trailing edge are reversed by reversely rotating the sheet discharge roller 69, so that the recording material S is conveyed to the duplex conveyance path 603. Thereafter, the recording material S is again conveyed to the conveyance path 64 by a resupply roller 604. The subsequent conveyance and the image forming process for the back side of the recording material S are similar to those in the above-described case, and thus a description thereof is omitted.

Incidentally, for example, the developing device 3 is provided with a screw (not illustrated) for circulating and conveying the toner in the developing device 3 storing the toner, and frictional heat is generated in a bearing portion of the screw and the toner with the rotation of the screw, so that a temperature of the developing device 3 rises. However, in a case where the temperature of the developing device 3 rises to a predetermined temperature or higher, the toner may be melted in the developing device 3. In this case, as the toner is electrostatically carried and rotated, the molten toner is also physically attached to a developing sleeve 3A that conveys the toner toward the photosensitive drum 1, which can lead to a coating failure of the developing sleeve 3A. In a case where the coating failure occurs in the developing sleeve 3A, the toner image cannot be appropriately developed on the photosensitive drum 1, and as a result, an image failure occurs in the recording material S. In addition, heat applied for fixing the toner image remains on the recording material S that has passed through the fixing device 9. In a case where there is a large amount of residual heat, the recording material S is curled, and the recording material S is discharged to the sheet discharge tray 601 while the toner has adhesiveness, which causes the loaded recording materials S to adhere to each other due to the toner, which is not preferable.

Therefore, the image forming apparatus 100 of the present embodiment includes an air intake unit that sucks outside air in order to cool the image forming units 600Y to 600K and the conveyance device 30. Hereinafter, an air intake configuration in the image forming apparatus 100 of the present embodiment will be described using FIGS. 3 to 7B with reference to FIGS. 1 and 2.

Figure 3:
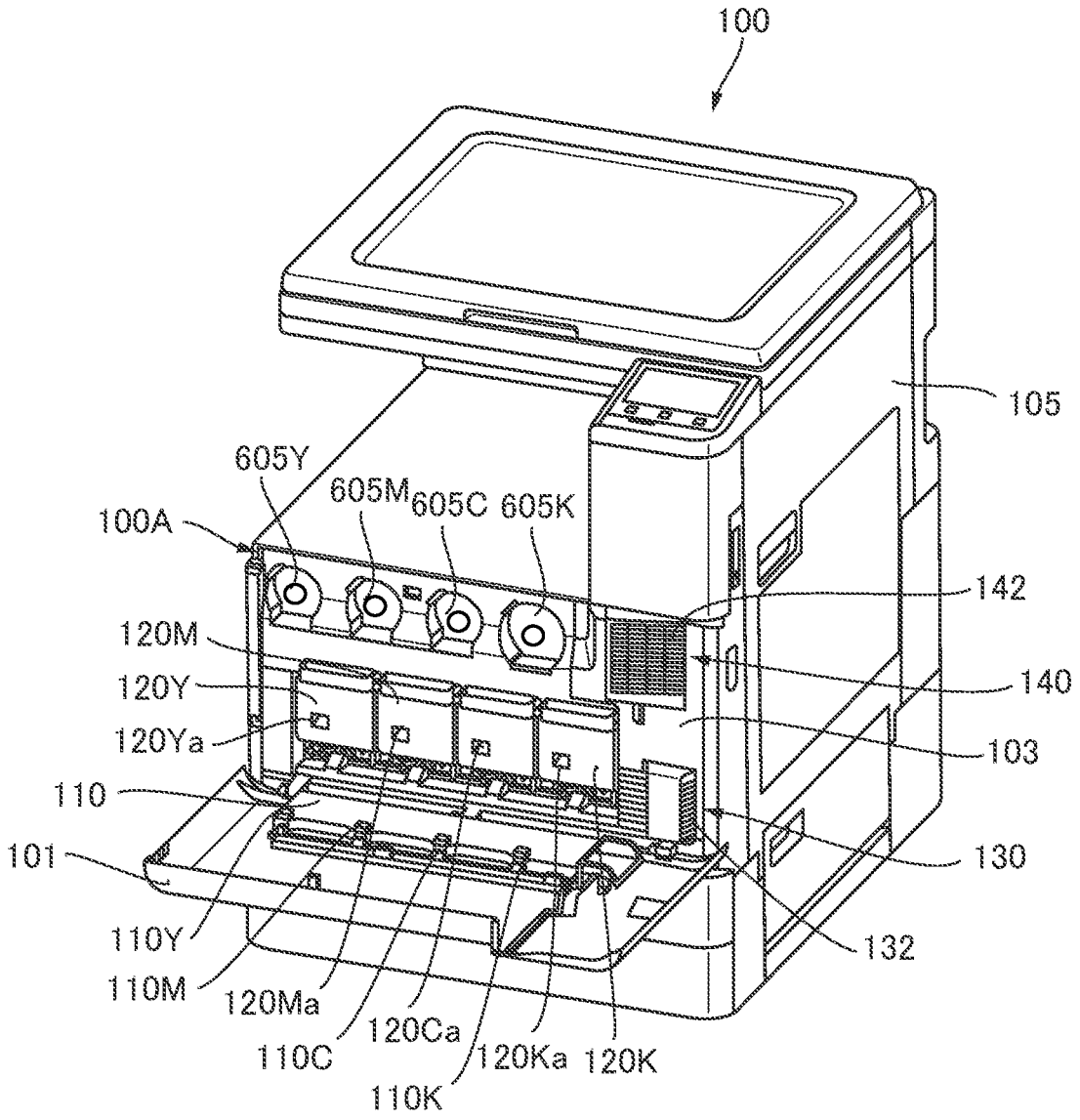
FIG. 3 is a perspective view illustrating the image forming apparatus in a state where a front cover is opened.

The image forming units 600Y to 600K and the toner bottles 605Y to 605K are detachably provided in the image forming apparatus 100 for replacement. In order to enable such a configuration, as illustrated in FIG. 3, the front cover 101 is provided to be openable and closable so as to open the front surface side of the image forming apparatus 100. In the present embodiment, the front cover 101 pivots around a lower side in the vertical direction as a pivot axis. In addition, an inner cover 103 opened to allow insertion and removal of the image forming units 600Y to 600K and the toner bottles 605Y to 605K is fixed to the support frame 100A on an inner side of the apparatus than the front cover 101 is. The inner cover 103 is disposed to face an inner surface of the front cover 101 in a closed state, and separates the front cover 101 from the heat sources such as the image forming units 600Y to 600K. In addition, the side surface cover 105 is provided to be openable and closable in the image forming apparatus 100 in order to remove the recording material S in a case where a conveyance abnormality (a so-called jam) occurs in the conveyance device 30, the duplex conveyance path 603, and the like. The side surface cover 105 in the closed state forms a conveyance path for conveying the recording material S. Note that, in the present embodiment, the pivot axis of the front cover 101 is the lower side in the vertical direction, but the rotation axis may be provided on the left side in a left-right direction (width direction) of the image forming apparatus 100.

Openable front doors 120Y, 120M, 120C, and 120K are disposed in openings of the inner cover 103 through which the image forming units 600Y to 600K are inserted and removed. The front doors 120Y, 120M, 120C, and 120K have through holes 120Ya, 120Ma, 120Ca, and 120Ka through which the sucked outside air passes. Note that, in the present embodiment, unlike the front cover 101, the front upper cover 104 is fixed to the support frame 100A or the like by screws, snap-fits, or the like so as not to be openable and closable.

Air Intake Unit

In the present embodiment, in order to cool the image forming units 600Y to 600K with outside air, a first air intake unit 130 is disposed in the inner cover 103 of the image forming apparatus 100. In order to cool the conveyance device 30, a second air intake unit 140 is disposed in the inner cover 103. As the outside air sucked by these air intake units (130 and 140) passes through the inside of the image forming apparatus 100, not only the heat sources such as the image forming units 600Y to 600K and the conveyance device 30 are cooled, but also a temperature rise in the image forming apparatus 100 due to the heat sources is suppressed.

Figure 4:
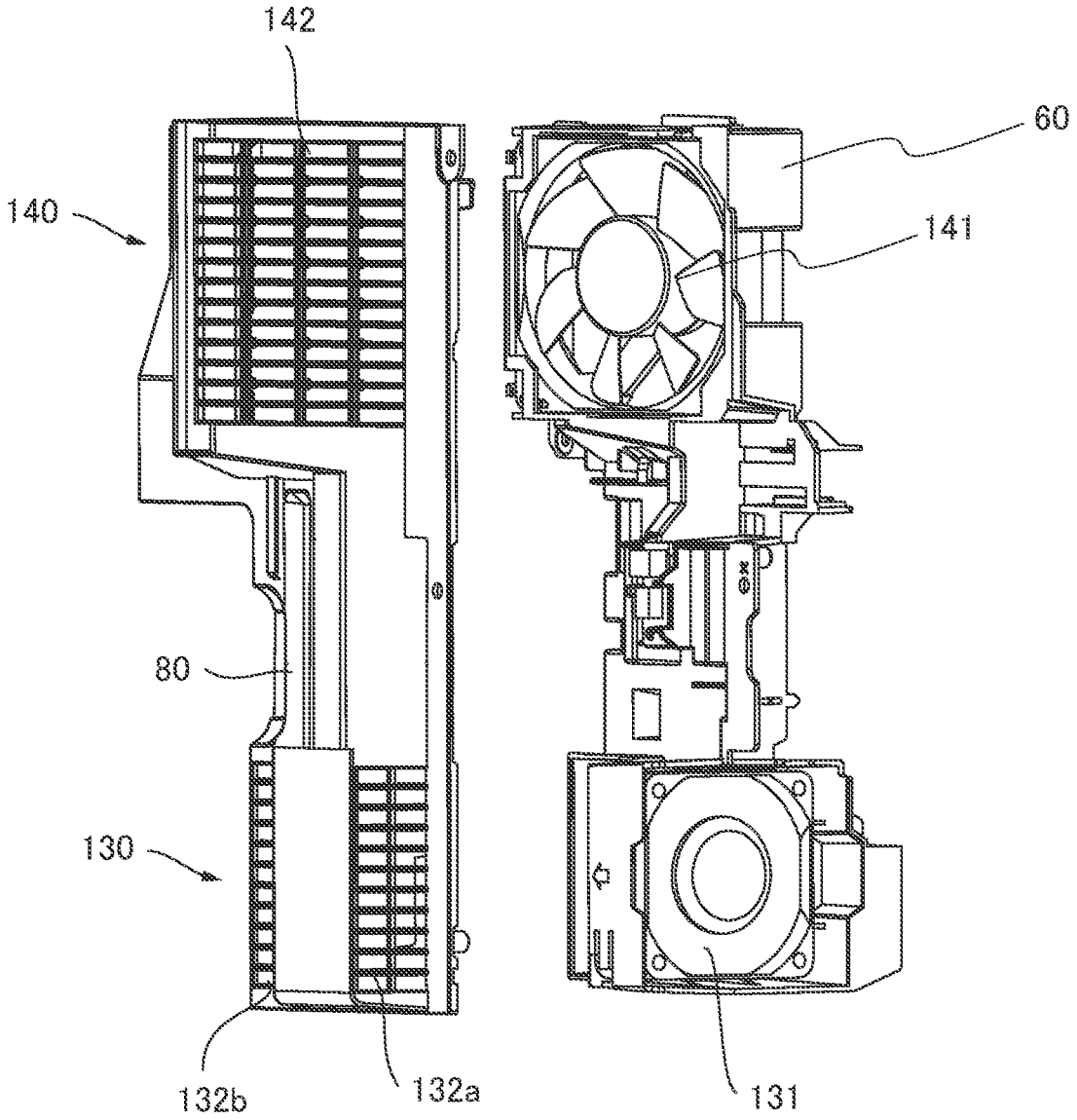
FIG. 4 is an exploded perspective view illustrating an air intake unit.

In the present embodiment, as illustrated in FIG. 4, the first air intake unit 130 and the second air intake unit 140 are formed to be arranged at upper and lower positions in the vertical direction in the inner cover 103 at the same time. The first air intake unit 130 includes a first air intake fan 131 and louvers 132*a* and 132*b*, and the second air intake unit 140 includes a second air intake fan 141 and a louver 142. The first air intake fan 131 and the second air intake fan 141 are attached to a fan holder 60, and the louvers 132*a* and 132*b* and the louver 142 are formed in a cover member 80.

By attaching the cover member 80 to the fan holder 60, the first air intake fan 131 capable of sucking outside air is disposed on the inner side of the louvers 132*a* and 132*b*, and the second air intake fan 141 capable of sucking outside air is disposed on the inner side of the louver 142. The outside air is sucked by the first air intake fan 131 and the second air intake fan 141, and an airflow flowing into the image forming apparatus 100 via each of the louvers (132*a*, 132*b*, and 142) including a plurality of plate-like members arranged at intervals is formed.

Returning to FIG. 3, a communication port is formed at an arrangement position of the louver 142 in the inner cover 103, and the outside air sucked by the second air intake fan 141 is guided to the communication port by the louver 142 and flows into the image forming apparatus 100 through the communication port. That is, the louver 142 serving as a ventilation change portion is disposed at the communication port of the inner cover 103, and mainly changes a ventilation direction of a part of the outside air sucked by the second air intake fan 141 toward the conveyance device 30 (heat source) in the image forming apparatus 100. Accordingly, the conveyance device 30 is cooled by the outside air sucked by the second air intake fan 141. Thereafter, the outside air is exhausted from the back surface side of the image forming apparatus 100.

The second air intake fan 141 may be configured to suck air outside the image forming apparatus 100 to generate an airflow for cooling the toner bottles 605Y to 605K. For example, by forming an airflow from the toner bottle 605K toward the toner bottle 605Y in an arrangement direction of the toner bottle 605K (a width direction of the image forming apparatus 100), the toner bottles 605Y to 605K can be cooled by outside air.

On the other hand, in order to cool the image forming units 600Y to 600K with outside air, in addition to the first air intake unit 130, an inner duct 110 is provided on an inner side of the front cover 101 (a side opposite to an exterior surface), and cooling ducts 150Y, 150M, 150C, and 150K (see FIG. 5) are provided in the support frame 100A. The cooling ducts 150Y to 150K serving as first ducts extend in a longitudinal direction of the image forming units 600Y to 600K below the image forming units 600Y to 600K in the vertical direction. The inner duct 110 serving as a second duct extends in an arrangement direction of the image forming units 600Y to 600K (the width direction which is the left-right direction of the image forming apparatus 100).

Figure 5:
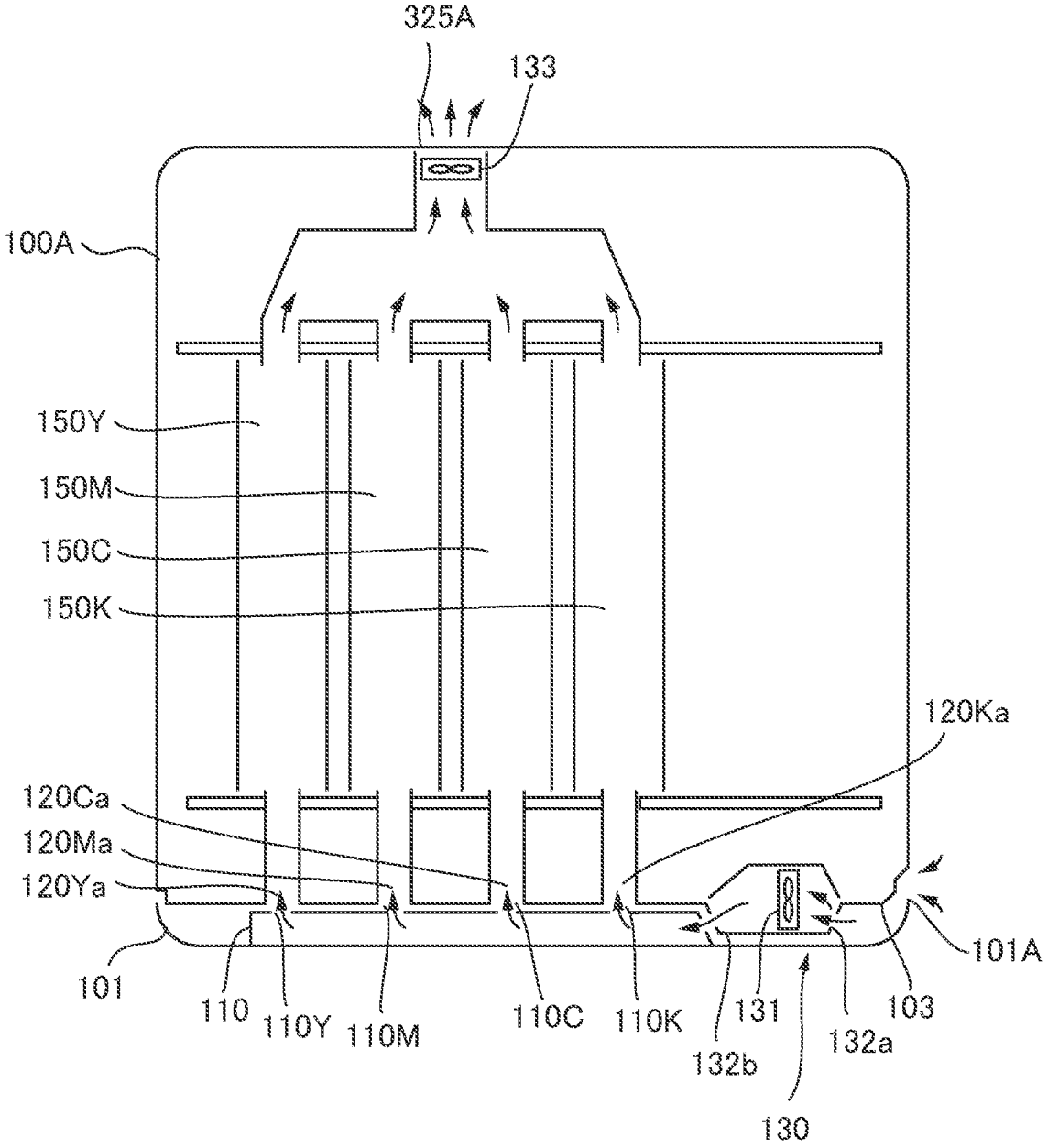
FIG. 5 is a cross-sectional view taken along line A-A in FIG. 2.

As illustrated in FIG. 5, the outside air sucked through the louver 132*a* by the first air intake fan 131 passes through the louver 132*b* and is guided to the inner duct 110. That is, the louvers 132*a* and 132*b* serving as ventilation guide portions mainly guide a part of the outside air sucked by the first air intake fan 131 to the inner duct 110. The inner duct 110 has opening portions 110Y, 110M, 110C, and 110K corresponding to the four cooling ducts 150Y to 150K. These opening portions 110Y to 110K are formed at positions corresponding to the through holes 120Ya, 120Ma, 120Ca, and 120Ka of the front doors 120Y to 120K. Therefore, the outside air guided to the inner duct 110 by the louvers 132*a* and 132*b* flows into the respective cooling ducts 150Y to 150K through the opening portions 110Y to 110K and the through holes 120Ya to 120Ka. In this manner, the image forming units 600Y to 600K are cooled by the outside air passing through the cooling ducts 150Y to 150K. Thereafter, the outside air is exhausted from the back surface side of the image forming apparatus 100.

In the present embodiment, an airflow that is sucked through an air intake port 101A to be described later and exhausted through an air exhaust port 325A formed on the back surface side is formed by the air intake fans (131 and 141). As illustrated in FIG. 5, it is preferable that an air exhaust fan 133 for air exhaust is disposed in front of the air exhaust port 325A. In a case where the air exhaust fan 133 is provided, cooling using outside air can be efficiently performed.

The reason why the air intake port for sucking the outside air is formed on the front surface side or the side surface side is that it is more suitable than a case where the air intake port is formed on the back surface side in consideration of an installation condition of the image forming apparatus 100. That is, in consideration of user operability of the operation unit 46, the image forming apparatus 100 is installed in a state where the back surface faces a wall surface or the like of an installation place. In such a case, if the air intake port is formed on the back surface side, suction of air by the air intake fans (131 and 141) is easily hindered by the wall surface. In order to avoid such a problem, the air intake port is preferably formed on the front surface side or one side surface side. On the other hand, the reason why the air exhaust port is formed on the back surface side is that in a case where a temperature of the exhausted outside air becomes high and the air exhaust port is formed on the front surface side, high-temperature outside air is blown to the user who operates the operation unit 46, which makes the user uncomfortable. Therefore, the air exhaust port is formed on the back surface side. Note that in a case where the air intake port is formed on the side surface side, it is preferable to form the air intake port on the front surface side as much as possible in accordance with the formation of the air exhaust port on the back surface side in order to generate an airflow appropriate for cooling the inside of the image forming apparatus 100.

Incidentally, generally, a so-called louver in which a plurality of plate-like members are arranged at intervals is provided in the air intake port in many cases, which has an advantage that the area of the air intake port can be increased. However, according to the related art, the air intake port including such a louver is formed on the front surface side which is easily visually recognized by the user, and the appearance quality of the image forming apparatus is thus deteriorated. In addition, under the condition that an outside air temperature and humidity rapidly change, the outside air having a temperature and humidity relatively higher than those in the image forming apparatus tends to quickly flow into the apparatus through the air intake port having a large area, and thus there is a possibility that dew condensation occurs in the apparatus. Furthermore, an operating sound of, for example, a motor or the like provided in the apparatus leaks out from the air intake port, and the operating sound is unpleasant to the user.

Air Intake Port

Figure 6:
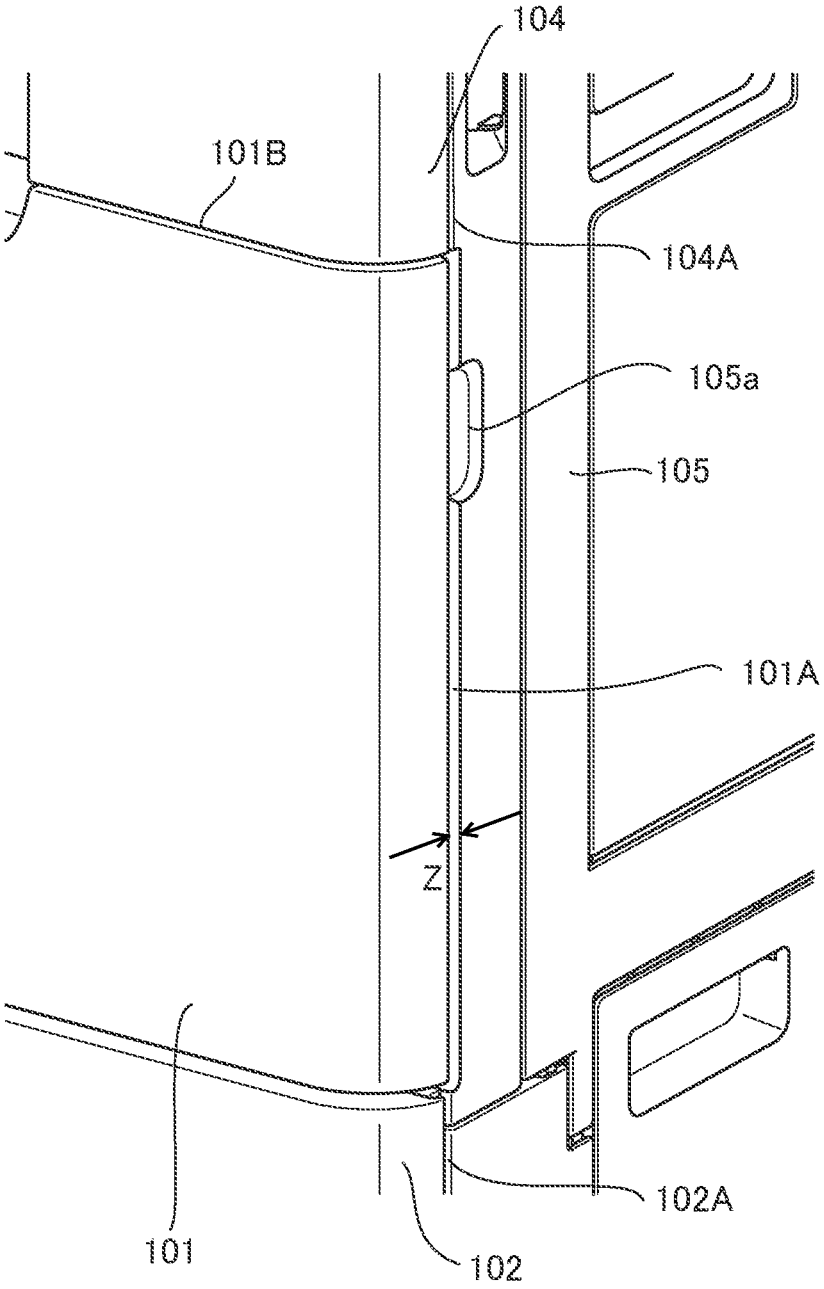
FIG. 6 is a partially enlarged view illustrating an air intake port of the image forming apparatus.

Therefore, as illustrated in FIG. 6, a first gap extending in the vertical direction is formed between the front cover 101 and the side surface cover 105 in a state where the front cover 101 is closed. In the present embodiment, the first gap serves as the air intake port 101A.

In other words, the air intake port 101A is formed by generating a gap between the front cover 101 serving as a first exterior cover and the side surface cover 105 serving as a second exterior cover.

The side surface cover 105 has a recess 105*a* formed to be recessed toward the inside of the apparatus with respect to the exterior surface. The recess 105*a* is provided in a region where the air intake port 101A is provided in the vertical direction. Therefore, in a case where the user or a service engineer opens the front cover 101, fingers are easily hooked from the recess 105*a* to an end portion of the front cover 101, so that the user operability can be improved while improving the appearance quality. Note that, in the above description, the side surface cover 105 is openable and closable with respect to the support frame 100A. However, as long as the recording material on the conveyance path can be removed in a case where a conveyance abnormality occurs, a portion of the side surface cover 105 where a unit constituting the conveyance path is provided may be openable and closable with respect to the support frame 100A, and the other portion may be fixed. For example, as illustrated in FIG. 6, a portion where the recess 105*a* is provided may be fixed to the support frame 100A with a screw or the like.

Further, the air intake port 101A is formed to extend in the vertical direction along the arrangement of the first air intake unit 130 and the second air intake unit 140 so as to serve as both the air intake ports of the first air intake unit 130 and the second air intake unit 140. That is, the air intake port 101A elongated in the vertical direction is formed so that both the first air intake unit 130 and the second air intake unit 140 can sufficiently suck the outside air.

Figure 7A:
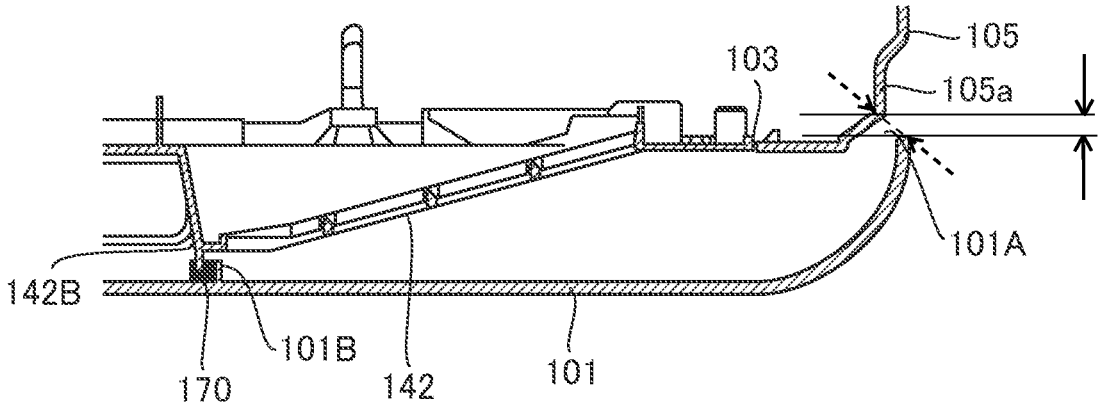
FIG. 7A is a cross-sectional view taken along line B-B in FIG. 2.
Figure 7B:
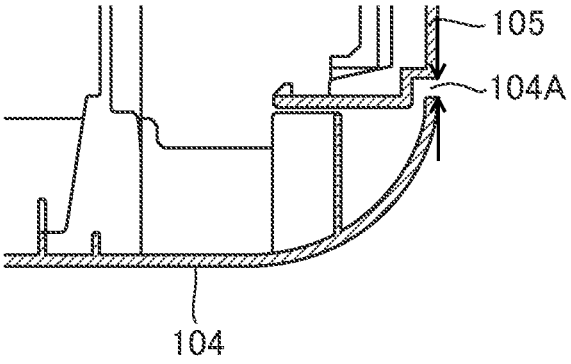
FIG. 7B is a cross-sectional view taken along line C-C in FIG. 2.

As illustrated in FIG. 7A, the air intake port 101A implemented by the first gap communicates with a space formed between the front cover 101 and the inner cover 103 in a state where the front cover 101 is closed, and an air intake path to the louver 142 is secured. As illustrated in FIG. 5, air intake paths to the louvers 132*a*, 132*b* are also secured.

In a direction intersecting a first surface provided with the front cover 101, the air intake port 101A is opened wider than a second gap that can be generated between the front upper cover 104 serving as a third exterior cover and the side surface cover 105 serving as the second exterior cover. That is, a gap length of the air intake port 101A, specifically, an interval forming the air intake port 101A between the end portion of the front cover 101 to an end portion of the side surface cover 105, is larger than a gap length of a gap 104A that can be generated between the front upper cover 104 and the side surface cover 105 illustrated in FIG. 7B.

In the present embodiment, a minimum gap length (broken line in FIG. 7A) of the air intake port 101A is 4.8 mm, and a minimum gap length (solid line in FIG. 7B) of the gap 104A is 1 mm. The gap length of the air intake port 101A is larger than that of the gap 104A even in consideration of an assembly tolerance between the front upper cover 104 and the side surface cover 105. Note that, although FIG. 7A is a cross-sectional view of a position where the recess 105*a* is provided, the gap length of the air intake port 101A is larger than the gap length of the gap 104A also at a position above or below the recess 105*a* in the vertical direction. As illustrated in FIGS. 6 and 7A, a surface of the side surface cover 105 that faces the end portion of the front cover 101 is inclined with respect to a surface constituting an appearance of the side surface cover 105. A gap length Z (see FIG. 6) between the surface constituting the appearance of the side surface cover 105 excluding the inclined portion and the end portion of the front cover 101 is 7 mm. As described above, since the gap length of the air intake port 101A is larger than the gap length of the gap 104A between the front upper cover 104 and the side surface cover 105 even in a case where the air intake port 101A has the minimum gap length, the air intake port 101A can act as an air intake port for sucking air into the image forming apparatus 100. Note that, since the gap 104A between the front upper cover 104 and the side surface cover 105 is not an air intake port, the gap length may be 0.

As described above, in the present embodiment, the first gap (101A) extending in the vertical direction is formed between the front cover 101 and the side surface cover 105 in a state where the front cover 101 is closed. The first gap (101A) communicates with a space formed between the front cover 101 and the inner cover 103 provided to face the inner side of the front cover 101 in a state where the front cover 101 is closed. In the inner cover 103, the louvers 132*a* and 132*b* and the louver 142 are disposed, and the air intake paths to the louvers 132*a* and 132*b* and the louver 142 are secured along with suction of outside air by the intake fans (131 and 141). In the configuration in which the outside air is sucked through the first gap as the air intake port 101A, an airflow of the outside air passing through the inside of the apparatus can be secured, and the appearance quality of the apparatus is not deteriorated.

In addition, in a case where air is sucked through the air intake port 101A described above, the inside and the outside of the apparatus are less likely to be affected by each other as compared with a case of a configuration in which the air intake port is formed in the exterior cover as in the related art, which is preferable. As described above, according to the related art, there is a possibility that dew condensation occurs in the apparatus under the condition that an outside air temperature and humidity rapidly change, and the operating sound of the motor or the like is likely to leak to the outside.

On the other hand, in a case where the air intake port 101A elongated in the vertical direction is formed without opening the exterior cover as in the present embodiment, dew condensation is less likely to occur in the apparatus, and the operating sound of the motor or the like is less likely to leak to the outside. As described above, as the first gap extending in the vertical direction is formed between the front cover 101 and the side surface cover 105, and the first gap is used as the air intake port 101A, it is possible to ensure air intake performance at the same time without deteriorating the appearance of the image forming apparatus 100.

Sealing Member

Figure 8:
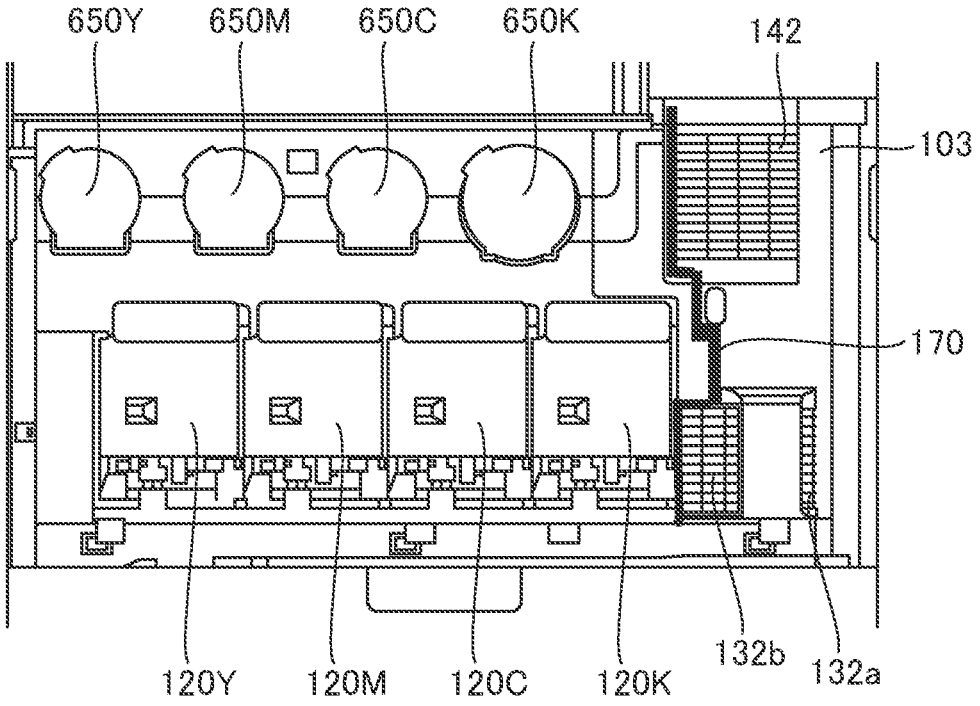
FIG. 8 is a partial front view illustrating the image forming apparatus in a state where the front cover is opened.
Figure 9:
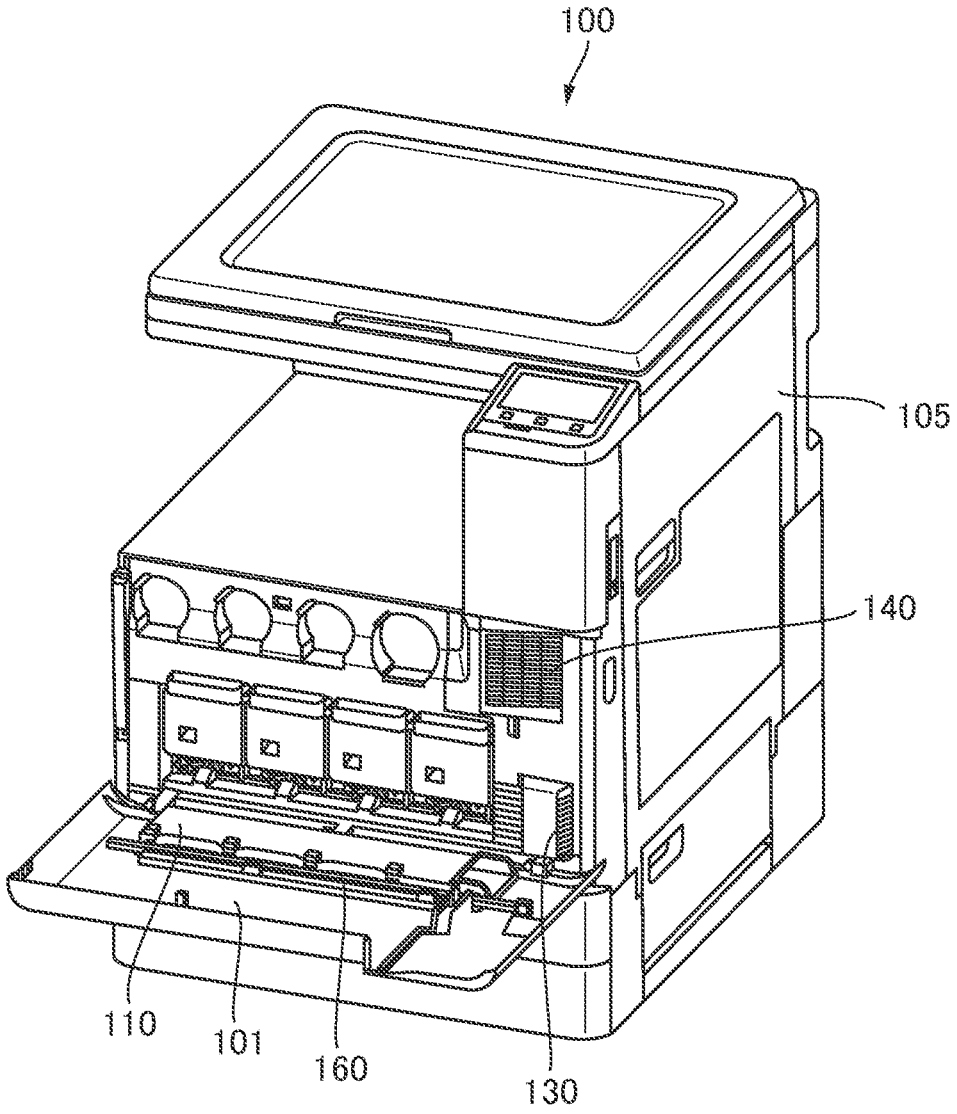
FIG. 9 is a perspective view illustrating the image forming apparatus in a state where the front cover to which a cleaner member is attached is opened.

Next, a sealing member will be described with reference to FIGS. 8 to 10. As illustrated in FIG. 8, in the present embodiment, the louvers 132*a* and 132*b* and the louver 142 are collectively disposed at positions close to the air intake port 101A in order to easily suck outside air through the air intake port 101A. Even with this disposition, suction of the outside air is sufficiently possible, but the outside air can also be sucked from the opposite side (the left side in FIG. 8) where the louvers 132*a* and 132*b* and the louver 142 are not disposed. However, if the suction of the outside air can be limited to the air intake port 101A, cooling can be performed using the outside air whose temperature is closer to the outside air temperature, so that cooling efficiency can be increased. Therefore, as illustrated in FIG. 8, a seal 170 is preferably disposed at a boundary between a space where the louvers 132*a* and 132*b* and the louver 142 are disposed and a space on the left side thereof.

The seal 170 serving as a shielding member is, for example, a sponge, and is provided adjacent to the front cover 101. The seal 170 is formed over the entire area of the front cover 101 in the vertical direction along a rib 101B (see FIG. 7A) formed on a back surface (a side opposite to the exterior surface) of the front cover 101. As illustrated in FIG. 7A, a rib 142B is also formed adjacent to the louver 142. The rib 142B is provided so as to enter the seal 170 in a state where the front cover 101 is closed. Thus, the space formed between the front cover 101 and the inner cover 103 is shielded without a gap by the ribs (101B and 142B) and the seal 170. As a result, the space formed by the front cover 101 and the inner cover 103 is shielded so that the outside air sucked through the air intake port 101A passes through the louvers (132*a*, 132*b*, and 142).

That is, the outside air used for cooling is limited to outside air sucked through the air intake port 101A, and it is possible to suppress formation of an airflow by using air warmed inside the image forming apparatus 100, so that the cooling efficiency can be improved.

As illustrated in FIG. 8, in a space on the left side of the louver (132*a*, 132*b*, and 142), openings 650Y, 650M, 650C, and 650K are formed, and the front doors 120Y, 120M, 120C, and 120K are disposed. The openings 650Y to 650K are insertion openings for the toner bottles 605Y, 605M, 605C, and 605K (see FIG. 3) that supply the toner to the image forming units 600Y to 600K. Although a small amount of toner scattered at the time of the toner image forming operation or the replenishing operation may adhere to the periphery of the openings 650Y to 650K, the outside air can be introduced into the image forming apparatus 100 while preventing the toner from being introduced by making it difficult to suck air through other than the air intake port 101A by using the seal 170. Therefore, it is advantageous because toner scattering due to introduction of outside air does not occur.

Incidentally, there is a case where a component not related to the airflow is attached inside the front cover 101. As illustrated in FIG. 9, for example, a rod-shaped cleaner member 160 is attached in the vicinity of the inner duct 110. The cleaner member 160 is, for example, a cleaning member provided in the exposing device 68 and used to remove the toner in a case where a glass member that transmits laser light is contaminated with the toner. The cleaner member 160 is not necessarily attached to the front cover 101, but attachment to the front cover 101 improves work efficiency at the time of performing cleaning work by the user or the service engineer.

Figure 10:
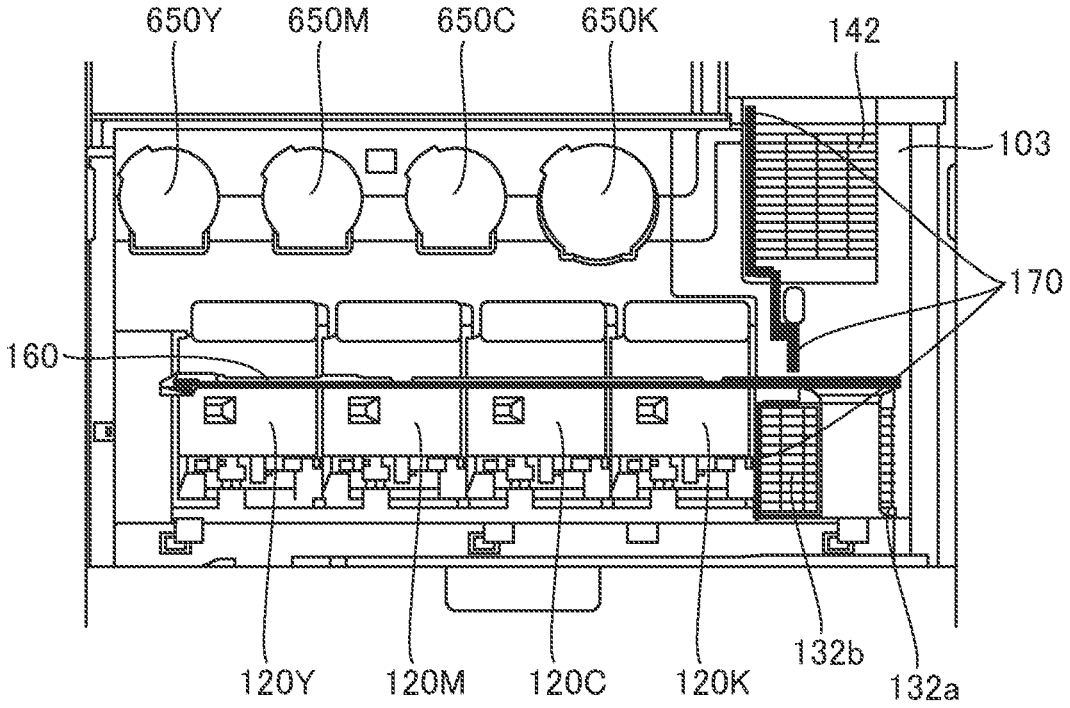
FIG. 10 is a partial front view illustrating the cleaner member and a seal.

In such a case, FIG. 10 illustrates a positional relationship between the cleaner member 160 and the seal 170 in a state where the front cover 101 is closed. In FIG. 10, the seal 170 is disconnected at the position of the cleaner member 160, and a gap is generated in the seal 170. However, the gap is small as compared with the entire length of the seal 170, and such a small gap does not affect the effects of improving the cooling efficiency and suppressing toner scattering described above.

Air Exhaust Configuration

Figure 11:
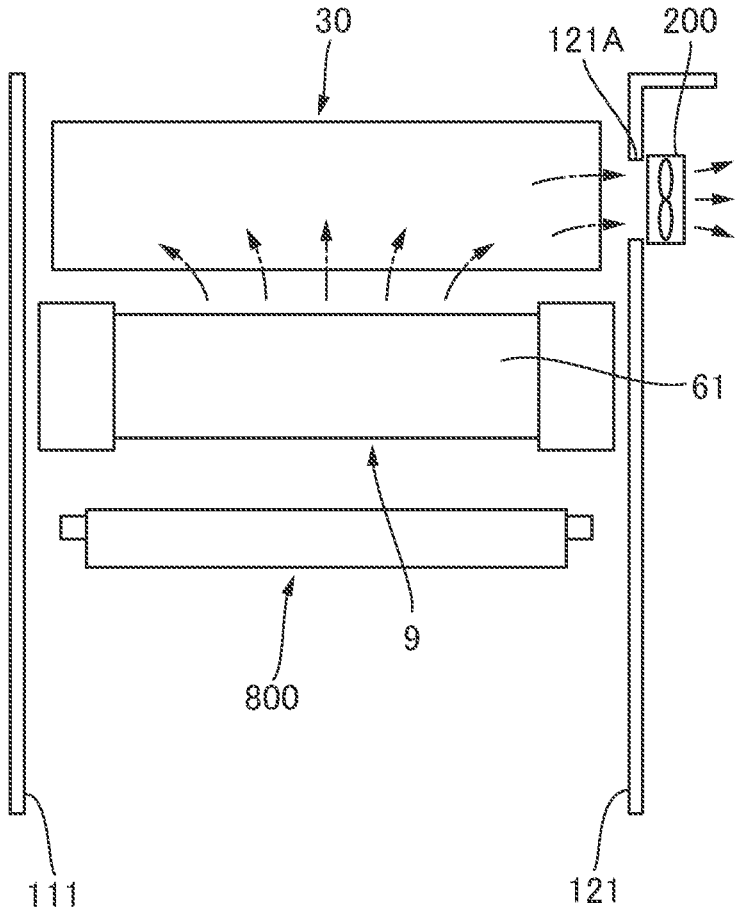
FIG. 11 is a schematic view for describing an outline of air exhaust in the image forming apparatus.

Next, an air exhaust configuration will be described using FIGS. 11 to 15 with reference to FIGS. 1 and 2. As illustrated in FIG. 11, in the image forming apparatus 100, the intermediate transfer belt unit 800, the fixing device 9, and the conveyance device 30 are disposed between the front side plate 111 disposed on the front surface side of the support frame 100A and the back side plate 121 disposed on the back surface side. The intermediate transfer belt unit 800, the fixing device 9, and the conveyance device 30 are directly or indirectly supported by the front side plate 111 and the back side plate 121. The amount of moisture contained in the recording material S supplied from the sheet cassette 62 (see FIG. 1) can vary depending on a storage status of the recording material S, an ambient temperature and humidity, and the like. For example, in a case of the recording material S left in a high-humidity environment, the recording material S contains a large amount of moisture. In a case of the recording material S containing a large amount of moisture, as heat and pressure are applied by the fixing device 9, the contained moisture is vaporized to become water vapor and diffused to downstream of the fixing device 9 in a recording material conveyance direction. In FIG. 11, a broken arrow indicates a diffusion state of vaporized water vapor.

In a case where the number of recording materials S supplied from the sheet cassette 62 is small and in a case where each of the recording materials S is supplied at a sufficient interval even if the number of the recording materials S is large, the water vapor is diffused with the lapse of time and discharged to the outside of the apparatus. However, in a case where a large number of recording materials S are continuously supplied at short intervals, there is a possibility that the water vapor is saturated and dew condensation occurs in the apparatus. For example, in a case where dew condensation occurs on a guide surface of the conveyance device 30 that conveys the recording material S, there is a possibility that moisture adheres to the recording material S being conveyed or the intermediate transfer belt 61. In a case where moisture adheres to the recording material S or the intermediate transfer belt 61, an image failure occurs. Therefore, it is necessary to provide a configuration for discharging the water vapor on downstream of the fixing device 9 in the recording material conveyance direction.

In addition, as heat is applied by the fixing device 9, the recording material S after passing through the fixing device 9 is in a state of storing heat and thus has a high temperature. In general, the recording material S shrinks upon receiving heat, but in a case where there is a difference in the amount of heat between front and back surfaces of the recording material S, a difference occurs in the degree of shrinkage between the front and back surfaces, so that the recording material S is curled. The curled recording material S causes a conveyance failure such as a jam at the time of conveyance performed by the conveyance device 30, and causes a loading failure such as a decrease in number of loaded sheets or disturbance in loading in a case where the curled recording material S is loaded on the sheet discharge tray 601. Alternatively, there is a possibility that the recording materials loaded on the sheet discharge tray 601 adhere to each other due to the toner having adhesiveness by heat.

Therefore, in the present embodiment, in order to suppress the occurrence of dew condensation described above, it is possible to discharge the water vapor generated from the recording material S while cooling the recording material S with the outside air on downstream of the fixing device 9 in the recording material conveyance direction. As illustrated in FIG. 11, an air exhaust fan 200 is attached to an opening portion 121A of the back side plate 121. The air exhaust fan 200 is disposed on the back surface side behind the conveyance device 30. Such disposition is disposition in which an effect of cooling using sucked outside air is easily obtained and water vapor is easily discharged to the outside as indicated by a broken line.

Electrical Unit

Figure 12:
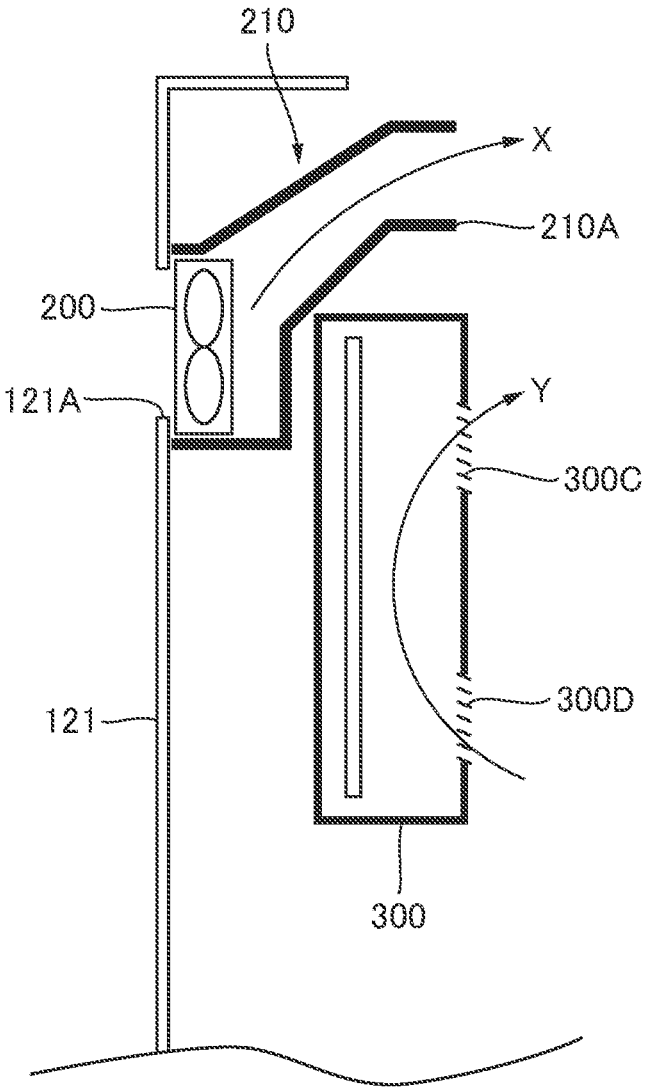
FIG. 12 is a schematic view for describing an air exhaust configuration of the image forming apparatus.

As illustrated in FIG. 12, the air exhaust fan 200 is provided in an air exhaust duct 210 and fixed to the back side plate 121 together with the air exhaust duct 210. The electrical unit 300 is also fixed to the back side plate 121.

Figure 13:
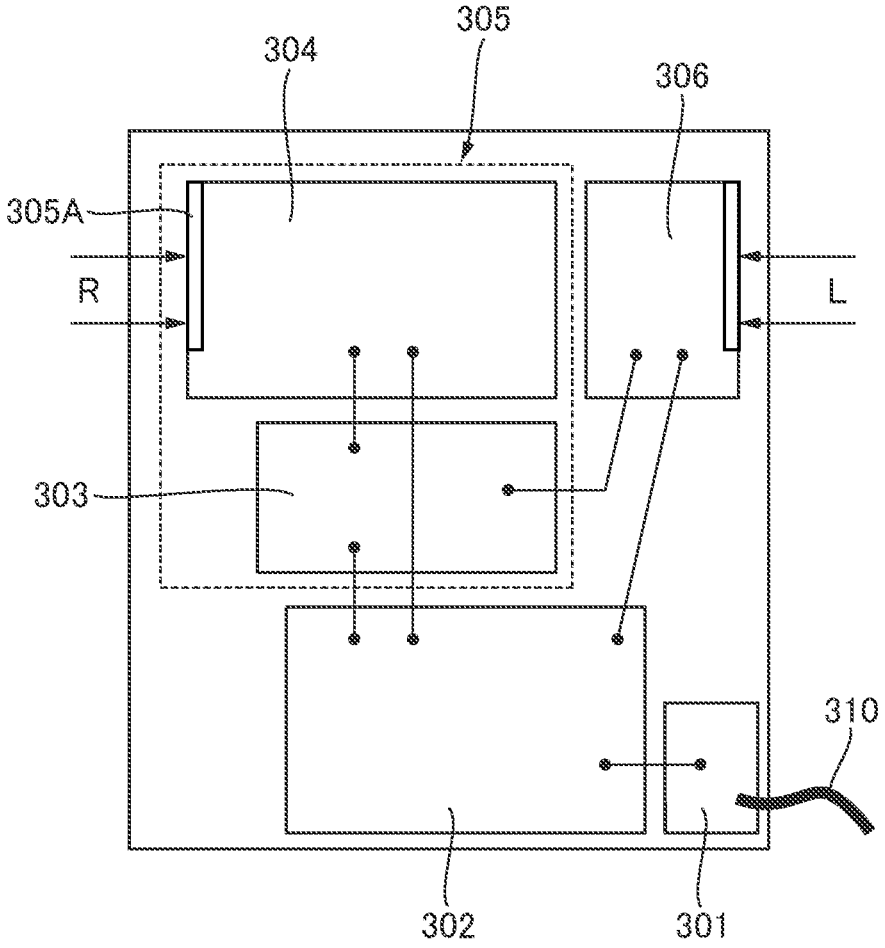
FIG. 13 is a schematic view illustrating an electrical unit.

The electrical unit 300 will be described. The electrical unit 300 illustrated in FIG. 13 is supplied with power necessary for driving the image forming apparatus 100 from an external power supply (not illustrated) connected via a power cord 310 fitted to an outlet, for example. Various electrical boards are mounted on the electrical unit 300 in the order of resupplying the supplied power. The electrical board is a board on which, for example, a CPU, a memory, an electronic component, an electric component, a connector, and the like are mounted. Examples of the electrical board include a power supply board 301 that receives power from an external power supply and performs voltage adjustment and the like, a power supply control board 302 that controls a motor and the like, and a control board 305 that executes a program such as an image forming job and transmits and receives various electric signals.

In the present embodiment, the power supplied from the external power supply is supplied to another electrical board, the motor, a temperature sensor, a switch, and the like through the power supply board 301 and the power supply control board 302. The power supply board 301 is disposed at the lowermost position in the electrical unit 300 from the viewpoint of connection of the power cord 310. The power supply control board 302 is disposed adjacent thereto, and the control board 305 is disposed above the power supply control board 302. The control board 305 includes a sub control board 303 and a main control board 304. Further, the control board 305 includes a USB standard connector or LAN connector 305A, and the connector 305A is exposed so that the user can attach and detach a USB memory or a LAN cable. The user attaches and detaches the USB memory or the LAN cable, for example, in a direction of an arrow R in the drawing. The electrical unit 300 is disposed on the upper side of the back side plate 121 in consideration of ease of such attachment and detachment of the USB memory and the LAN cable by the user.

In the present embodiment, the electrical unit 300 includes a facsimile control board 306 that implements a facsimile function for operating the image forming apparatus 100 as a facsimile machine. The facsimile control board 306 is disposed on the upper side of the back side plate 121 in the same manner as the control board 305 from the viewpoint of easy attachment and detachment because the user attaches and detaches a telephone line in a direction of an arrow L in the drawing.

Note that the electrical board described above needs to be cooled because the temperature rises with the image forming operation. Therefore, as illustrated in FIG. 12, a slit-shaped opening in which louvers 300C and 300D are provided is formed in the electrical unit 300. As convection indicated by an arrow Y naturally occurs by heat of the electrical board, outside air is sucked into the electrical unit 300 from the louver 300D, the electrical board is cooled by the sucked outside air, and the air is exhausted from the louver 300C to the outside of the electrical unit 300.

As illustrated in FIG. 12, the air exhaust duct 210 is inclined obliquely upward in such a manner that an air exhaust port 210A protrudes outward above the electrical unit 300. This is to cause air exhausted by the air exhaust fan 200 to flow upward as indicated by an arrow X in FIG. 12. This makes it difficult for the air exhausted by the air exhaust fan 200 to be sucked into the natural convection indicated by the arrow Yin FIG. 12, so that the cooling of the electrical board by the natural convection is not affected. Note that, in the embodiment illustrated in FIG. 12, the air exhaust duct 210 is formed horizontally at the air exhaust port 210A, but the length of the horizontal portion is small and does not affect the air exhausted upward.

Figure 14A:
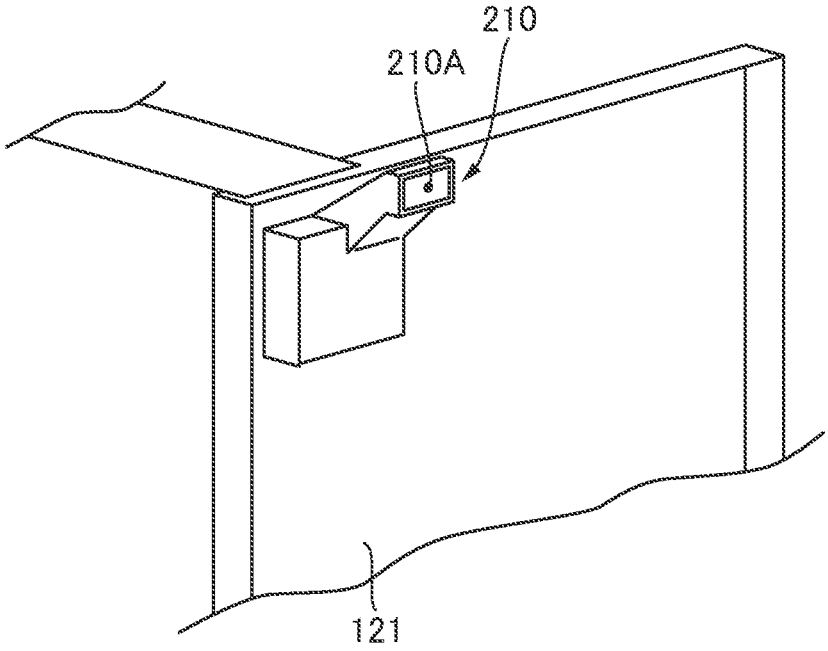
FIG. 14A is a perspective view illustrating an air exhaust unit.
Figure 14B:
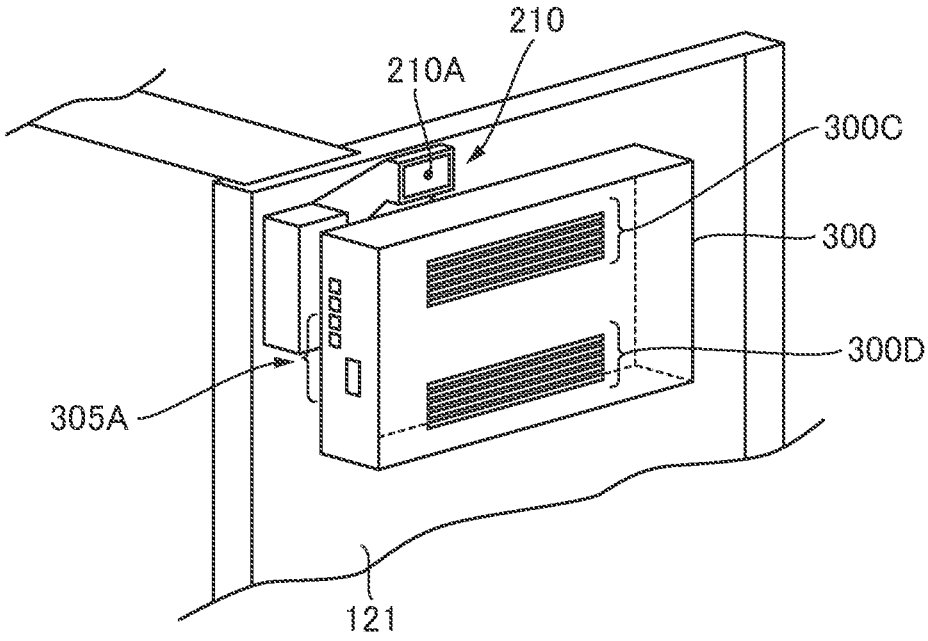
FIG. 14B is a perspective view illustrating the air exhaust unit and the electrical unit.

Next, FIGS. 14A and 14B are perspective views of the air exhaust port 210A as viewed from the back surface side. FIG. 14A illustrates a state where the air exhaust duct 210 is attached to the back side plate 121, and FIG. 14B illustrates a state where the electrical unit 300 is further attached.

Here, a case in which the air exhaust port 210A is not positioned above the electrical unit 300 and air is exhausted as it is from the air exhaust fan 200 to the back side of the apparatus is considered. First, as can be understood with reference to FIG. 13, a space for attaching the facsimile control board 306 is secured on the right side of the electrical unit 300. If the facsimile control board 306 is moved to a space therebelow or the facsimile control board 306 is not attached (that is, if the facsimile function is not compatible), the main control board 304 can be attached to an empty space. In such a case, it is possible to exhaust air directly from the air exhaust fan 200 to the back side of the apparatus.

However, in this case, air is exhausted at a height from the louver 300D to the louver 300C in FIG. 14B and flows to a back surface of the electrical unit 300, and the air exhausted by the air exhaust fan 200 is mixed with the natural convection, so that it is difficult to obtain the effect of cooling the electrical unit 300 by the natural convection. In addition, movement of the connector 305A of the main control board 304 to a recessed position makes it difficult for the user to access the connector 305A, and there is a possibility that the exhausted air hits the user and makes the user uncomfortable at the time of accessing the connector 305A. Therefore, a configuration in which the air exhaust port 210A is disposed above the electrical unit 300 is advantageous from the viewpoint of cooling the electrical unit 300 and from the viewpoint of the user operability with respect to the connector 305A.

Figure 15:
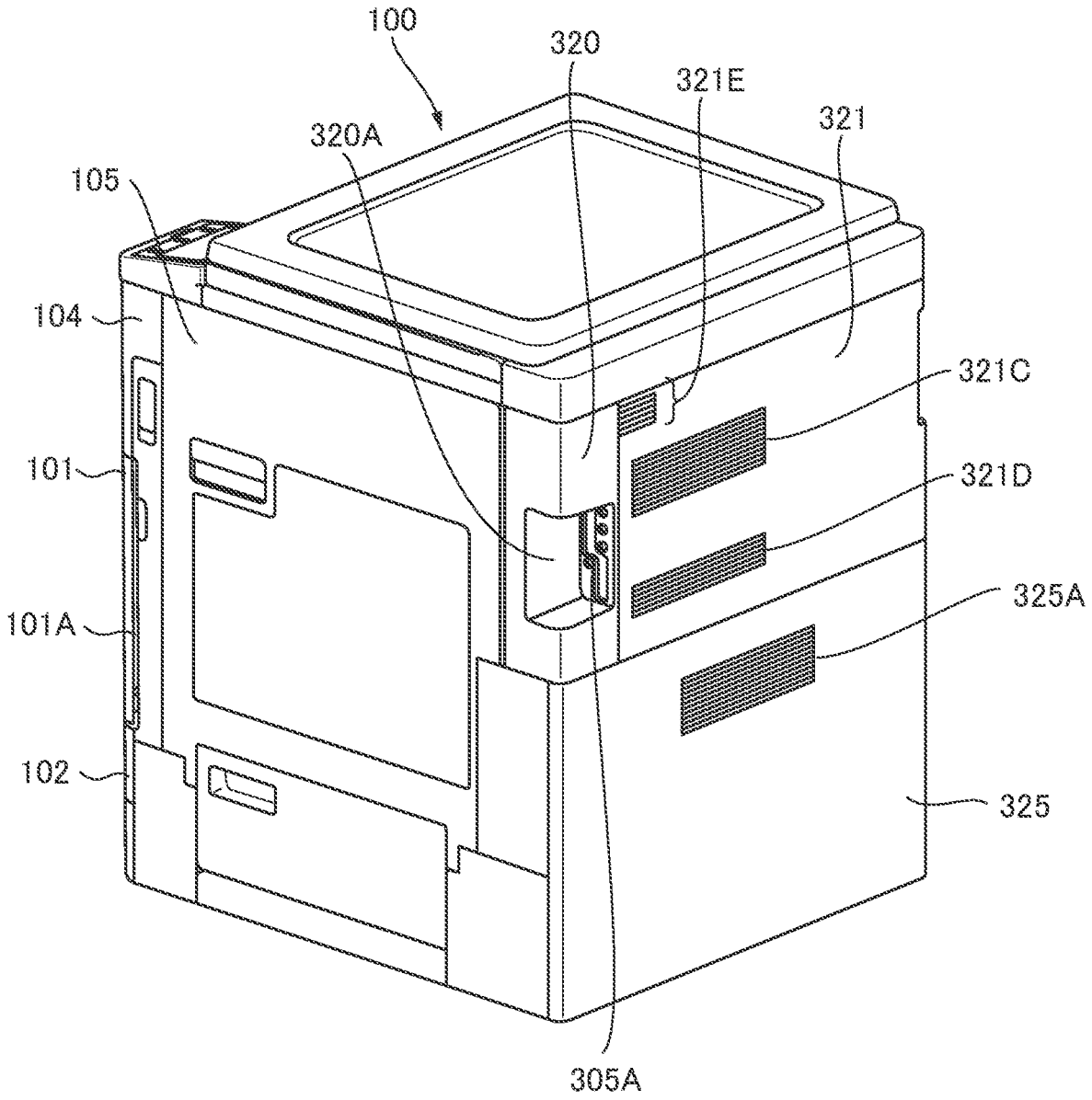
FIG. 15 is an exterior perspective view of the image forming apparatus as viewed from behind.

As illustrated in FIG. 15, the interface cover 320 and the back upper cover 321 are disposed as exterior covers on the back surface side of the image forming apparatus 100. The interface cover 320 has an exposing portion 320A that exposes the connector 305A so that the user can access the connector 305A.

The back upper cover 321 has openings at positions corresponding to the louvers 300C and 300D of the electrical unit 300 and the air exhaust port 210A (see FIG. 12) of the air exhaust duct 210, and louvers 321C, 321D, and 321E are disposed in the openings. These louvers (321C, 321D, and 321E) are disposed in the back upper cover 321 in the order of an air intake louver, an air exhaust louver, and an air exhaust louver from below, so that an influence of the air exhaust on outside air sucked through the air intake louver 321D can be reduced. In addition, since the exposing portion 320A is separated by a predetermined distance in a direction orthogonal to an air exhaust direction of each louver (321C, 321D, or 321E), the exhausted air does not hit the user at the time of accessing the connector 305A.

Note that the above-described embodiment is not limited to the electrophotographic image forming apparatus, and may be employed in other image forming apparatuses. For example, an inkjet method does not include a fixing device that applies heat and pressure, but includes a drying unit that generates heat, and thus the present embodiment is employed.

According to the present invention, it is possible to provide the image forming apparatus capable of having improved appearance quality and suppressing a temperature rise therein.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-081508, filed May 13, 2021, which is hereby incorporated by reference herein in its entirety.

What is claimed is:

1. An image forming apparatus that forms an image on a recording material, the image forming apparatus comprising:

a first exterior cover provided on a front surface of the image forming apparatus so as to be openable and closable;

a second exterior cover provided on a side surface of the image forming apparatus;

a third exterior cover fixed on a front surface side of the image forming apparatus and above the first exterior cover in a vertical direction; and a fan configured to suck outside air through a gap formed between the first exterior cover and the second exterior cover, wherein in a state where the first exterior cover is closed, the gap formed between the first exterior cover and the second exterior cover is larger than a gap formed between the third exterior cover and the second exterior cover.

2. The image forming apparatus according to claim 1, further comprising an inner cover disposed to face an inner surface of the first exterior cover in a closed state, wherein a gap formed between the first exterior cover and the second exterior cover communicates with a space formed between the first exterior cover and the inner cover in a state where the first exterior cover is closed.

3. The image forming apparatus according to claim 2, further comprising a ventilation change portion, wherein the inner cover has a communication port communicating with a space inside the image forming apparatus, and wherein the ventilation change portion includes a plurality of plate-like members disposed in the communication port of the inner cover and arranged at intervals, and is configured to change a ventilation direction of a part of the outside air sucked through the gap formed between the first exterior cover and the second exterior cover toward an inside of the image forming apparatus.

4. The image forming apparatus according to claim 2, further comprising:

a first duct provided inside the image forming apparatus and configured to guide the outside air;

a second duct provided on the inner surface of the first exterior cover and configured to guide the outside air toward the first duct; and a ventilation guide portion that includes a plurality of plate-like members arranged at intervals and is configured to guide a part of the outside air sucked through the gap formed between the first exterior cover and the second exterior cover to the second duct.

5. The image forming apparatus according to claim 3, further comprising:

a first duct provided inside the image forming apparatus and configured to guide the outside air;

a second duct provided on the inner surface of the first exterior cover and configured to guide the outside air toward the first duct;

a ventilation guide portion that includes a plurality of plate-like members arranged at intervals and is configured to guide a part of the outside air sucked through the gap formed between the first exterior cover and the second exterior cover to the second duct; and a shielding member provided on the inner surface of the first exterior cover and configured to shield a space formed by the first exterior cover and the inner cover in such a manner that the outside air sucked through the gap formed between the first exterior cover and the second exterior cover passes through the ventilation change portion and the ventilation guide portion.

6. The image forming apparatus according to claim 4, further comprising:

a plurality of image forming units configured to form a toner image on the recording material;

a fixing device configured to apply heat to the toner image formed on the recording material by the image forming units to fix the toner image to the recording material; and a conveyance device configured to convey the recording material that has passed through the fixing device, wherein the first duct is configured to guide the outside air to each of the plurality of image forming units.

7. The image forming apparatus according to claim 1, wherein an operation unit configured to input various types of information according to a user operation is provided on the front surface of the image forming apparatus.

* * * * *